US009434149B2

(12) United States Patent
Fuellgraf et al.

(10) Patent No.: US 9,434,149 B2
(45) Date of Patent: Sep. 6, 2016

(54) GRINDING METHOD FOR PRINTING FORMS IN THE AREA OF FLEXO OR RELIEF PRINTING

(71) Applicant: ContiTech Elastomer-Beschichtungen GmbH, Hannover (DE)

(72) Inventors: Stefan Fuellgraf, Duderstadt (DE); Torsten Raschdorf, Einbeck (DE)

(73) Assignee: ContiTech Elastomer-Beschichtungen GmbH, Hannover (DE)

( * ) Notice: Subject to any disclaimer, the term of this patent is extended or adjusted under 35 U.S.C. 154(b) by 0 days.

(21) Appl. No.: 14/668,612

(22) Filed: Mar. 25, 2015

(65) Prior Publication Data

US 2015/0197078 A1 Jul. 16, 2015

Related U.S. Application Data

(63) Continuation of application No. PCT/EP2013/066774, filed on Aug. 12, 2013.

(30) Foreign Application Priority Data

Sep. 26, 2012 (DE) ..... 10 2012 109 071

(51) Int. Cl.
*B41N 3/04* (2006.01)
*B41C 1/00* (2006.01)
*B24B 5/04* (2006.01)

(52) U.S. Cl.
CPC ..... *B41C 1/006* (2013.01); *B41N 3/04* (2013.01); *B24B 5/04* (2013.01)

(58) Field of Classification Search
None
See application file for complete search history.

(56) References Cited

U.S. PATENT DOCUMENTS

| | | | | |
|---|---|---|---|---|
| 2,495,269 | A * | 1/1950 | Lindmark | B41N 3/04 451/102 |
| 4,671,017 | A * | 6/1987 | Ideue | B24B 5/363 451/142 |
| 6,000,999 | A * | 12/1999 | Endo | B24B 7/13 451/178 |
| 6,159,659 | A | 12/2000 | Gelbart | |
| 6,468,138 | B1 * | 10/2002 | Toyama | B24B 29/04 451/259 |
| 6,616,974 | B1 | 9/2003 | Lorig et al. | |
| 6,866,985 | B2 | 3/2005 | Lorig et al. | |
| 2009/0197513 | A1 * | 8/2009 | Gouch | B24B 19/22 451/54 |

OTHER PUBLICATIONS

International Search Report dated Oct. 2, 2013 of international application PCT/EP2013/066774 on which this application is based.

* cited by examiner

*Primary Examiner* — Jill Culler
(74) *Attorney, Agent, or Firm* — Walter Ottesen, P.A.

(57) ABSTRACT

The invention is directed to a method for grinding a printing form in the area of flexographic or relief printing wherein the material to be ground is an elastomer material or an elastomer-containing material. A feed or first speed (v) is imparted to the material to be ground. The material is grindingly abraded with a grinding belt or grinding paper moving at a second speed (V) at least five times greater than the first speed (v).

9 Claims, 1 Drawing Sheet

GRINDING METHOD FOR PRINTING FORMS IN THE AREA OF FLEXO OR RELIEF PRINTING

CROSS REFERENCE TO RELATED APPLICATIONS

This application is a continuation application of international patent application PCT/EP2013/066774, filed Aug. 12, 2013, designating the United States and claiming priority from German application 10 2012 109 071.8, filed Sep. 26, 2012, and the entire content of both applications is incorporated herein by reference.

FIELD OF THE INVENTION

The invention relates to a grinding method for printing forms in the area of flexographic or relief printing.

BACKGROUND OF THE INVENTION

It has been known for a long time to set the thickness of the printing blankets for offset printing by means of grinding processes. The elastomeric flexographic printing forms are also ground on cylinder grinding machines for this purpose; here, the abrasion of the elastomeric material takes place, for example, via a grinding stone. In machines of this type, a grinding stone or grinding disc is used. By way of this, punctiform abrasion of the material by way of grinding takes place, in relation to the width of the grinding stone or the grinding disc. Here, the grinding is always performed after the vulcanization of the mixture of the elastomeric material; in this way, the mixture is fully cured and can be machined with the removal of material. The grinding can be carried out in one or more working processes.

It is disadvantageous here that vibrations occur repeatedly in the grinding machine as a result of the very highly crosslinked mixture in the case of hard, carbon black-filled elastomeric rubber mixtures (black mixtures), for example made from EPDM (ethylene propylene diene monomer or else ethylene propylene diene rubber) with a Shore A hardness of over approximately 45 ShA. The vibrations can build up and reinforce one another and are then evident as chatter marks or else vibration marks in the surface finish, that is, on the surface of the printing form. The inhomogeneous surface finish is visible in the varnish and in the ink transfer and therefore represents a quality defect.

In the case of very soft mixtures, for example made from SBR (styrene butadiene rubber) with a Shore A hardness of below approximately 45 ShA, the dimensional accuracy during grinding is continually a problem because of the extremely soft mixture.

SUMMARY OF THE INVENTION

It is an object of the invention to provide a grinding process of the type described above, by way of which grinding process flexographic or relief printing forms with both a hard, carbon black-filled laser-engravable surface (Shore A hardness of over approximately 45 ShA) and a soft (Shore A hardness of below approximately 45 ShA) surface made from an elastomer material can be ground as economically as possible to a uniform surface finish, both with a low tolerance, preferably of approximately ±0.015 mm over the complete width.

The method of the invention is for grinding a printing form in the area of flexographic or relief printing wherein the material to be ground is an elastomer material or an elastomer-containing material. The method includes the steps of: providing the material to be ground and imparting a feed or first speed (v) thereto; and, grindlingly abrading the material with a grinding belt or grinding paper moving at a second speed (V) at least five times greater than the first speed (v).

The present invention therefore relates to a grinding process for printing forms in the area of flexographic or relief printing, preferably by means of a belt or cylinder grinding machine. The grinding process is distinguished by the fact that the grinding abrasion takes place via a grinding belt or grinding paper, and the grinding belt or grinding paper moves at a speed which is at least five times higher than the advancing of the material to be ground.

In the area of flexographic or relief printing, the grinding of surfaces of the printing forms by means of grinding stone or grinding disc, that is, by means of punctiform abrasion, is customary and known. However, the abrasion has up to now not taken place over a full surface area, for example by means of a grinding belt or by means of grinding paper. The performance of the grinding process is also determined by a whole series of parameters and boundary conditions which have an effect on the result of the grinding process, namely substantially the surface condition of the surface to be ground after the grinding process.

Accordingly, the present invention is based on the finding that a surface condition according to the object can be achieved precisely by way of the use of full surface abrasion in combination with a defined ratio of advancing speed of the grinding belt or grinding paper or the like to the advancing speed of the material to be ground.

According to the invention, the grinding belt or grinding paper is therefore moved at a speed which is at least five times higher than the advancing of the material to be ground. In this way, a uniform surface finish which has a low tolerance of preferably approximately ±0.015 mm, is generated both in the case of a hard, carbon black-filled laser-engravable (Shore A hardness of over approximately 45 ShA) surface and in the case of a soft (Shore A hardness of below approximately 45 ShA) surface made from elastomer material. As a result, a uniform homogeneous surface print with satisfactory ink transfer and a low ink build-up on the rubber surface of the printing form can be achieved.

At the same time, the grinding process according to the invention is economical, since the method can be carried out comparatively rapidly in the case of a speed ratio of this type. As a result, the costs for printing forms which are ground according to the invention can be kept low.

The speed of the printing material to be ground is preferably at least approximately 1 m/min, preferably at most approximately 6 m/min, and the speed of the grinding belt or grinding paper is at least approximately 10 m/s, that is, approximately 600 m/min. In this case, the speed of the grinding belt or grinding paper is at least approximately 600 times higher than the advancing of the material to be ground.

The speed of the printing material to be ground is particularly preferably approximately 1 m/min, preferably at most approximately 6 m/min, and the speed of the grinding belt or grinding paper is at least approximately 20 m/s, that is, approximately 1200 m/min. In this case, the speed of the grinding belt or grinding paper is at least approximately 1200 times higher than the advancing of the material to be ground.

Not only solid materials made from elastomer material but also compressible elastomer-containing materials can be ground uniformly by means of the process according to the invention. These include, for example, printing forms for flexographic and relief printing which have at least one strength support layer and/or at least one compressible layer.

According to a feature of the invention, the granularity of the grinding belt or grinding paper is at least approximately 240 mesh.

It is advantageous here that satisfactory abrasion and the required surface quality can be achieved in the case of a granularity of this type.

According to another feature of the invention, the grinding width is greater than approximately 0.5 mm and smaller than approximately 20 mm.

The grinding width (also called nip width) or contact area is understood to mean the width, in which the grinding belt or grinding paper is in engagement with the material. Starting from a roll width of the material to be ground of, for example, approximately 2000 mm, that is, approximately 2 m, the nip width results from the extent of the feeding of grinding belt or grinding paper to material. The nip width multiplied by the roll width results in the contact area. The nip width should be greater than approximately 0.5 mm and smaller than approximately 20 mm, preferably greater than or equal to approximately 1 mm and smaller than or equal to approximately 10 mm. The grinding thickness and the surface quality are also substantially determined by the nip width.

It is advantageous here that the material-removing stroke and therefore the abrasive effect are distributed over a greater width in the case of a grinding width of this type.

According to another feature of the invention, the grinding is carried out at an angular setting of greater than approximately 0° and less than approximately 40°.

The angular setting is understood to mean the following: if it is assumed that the material to be ground runs horizontally, the angle, at which the grinding belt or grinding paper dips into the material and leaves the material, is then substantially a determining factor for the surface quality. The grinding thickness then results at the lowest point of the grinding belt or grinding paper. The angular setting can be different for different rubber mixtures (hardnesses). An angle of greater than approximately 0° and smaller than approximately 40°, preferably of greater than approximately 0° and smaller than approximately 20°, has proven advantageous.

It is advantageous here that the grinding results according to the object can be improved further by way of the angular setting. Roughnesses of below approximately 10 ym Rz can be produced in this way.

According to another feature of the invention, the counterpressure during grinding is generated by means of a soft or compressible roll.

Compressible grinding rolls have proven advantageous, in order not to transmit vibrations or excitation frequencies from the grinding machine onto the material to be ground. They therefore act as a damping element.

According to another feature of the invention, the grinding is carried out with a first step and a second step, the speed of the grinding belt or grinding paper being greater in the first step than in the second step, and/or the roughness of the grinding belt or grinding paper being greater in the first step than in the second step.

It is advantageous here that the extent of grinding or the surface quality is fixed in two grinding passes. Here, preliminary grinding with a rapid speed and a rough grinding paper of at least approximately 240 mesh is performed, and then precision grinding (also called final grinding) with a slow speed and fine grinding paper of at least approximately 600 mesh is performed. By way of the preliminary and precision grinding, a thickness of from at least approximately 0.02 mm to approximately 0.1 mm is ground away, preferably of from at least approximately 0.5 mm to approximately 0.1 mm, particularly preferably of at least approximately 0.8 mm to approximately 0.1 mm.

For the preliminary grinding (rapid speed), speeds of over approximately 2 m/min, preferably of over approximately 4 m/min, particularly preferably of over approximately 5 m/min, and for the final grinding (low speed), speeds of below approximately 2 m/min, preferably of below approximately 1 m/min, have proven themselves for the advancing of the material.

According to a further feature of the invention, the ground surface is polished by way of a following step.

Polishing is carried out by way of a negative grinding angle, at which the grinding paper, as described above, leaves the material to be ground slowly at an angle of less than approximately 20°.

According to another feature of the invention, at least 80% of the roll width is ground in one working process.

Here, the roll width is to be understood to mean the width of the material to be machined. A working process is to be understood to mean a continuous process, in which the grinding belt or grinding paper comes into engagement with the material to be ground and machining is carried out continuously with a parameter combination. An advantage of continuous machining of this type is that a large quantity of material can be machined in a short time. A constant surface condition over the roll width which is machined in this way can also be ensured by way of the constancy of the parameters.

One embodiment and further advantages of the invention will be explained in the following text.

BRIEF DESCRIPTION OF THE DRAWINGS

The invention will now be described with reference to the drawings wherein.

DESCRIPTION OF THE PREFERRED EMBODIMENTS OF THE INVENTION

The grinding method according to the invention can be implemented, for example, on a cylinder grinding machine as described below.

In a first step, the grinding belt or grinding paper is fastened on the grinding cylinder and the printing form to be ground is guided around the counterpressure cylinder. It is important here that the grinding paper is fastened fixedly on the grinding cylinder and the material can roll on the counterpressure cylinder. Here, a grinding paper can also be used for grinding a plurality of printing forms, with the result that it does not have to be replaced after every grinding process.

In a second step, the grinding cylinder with the grinding paper is accelerated to the desired speed. Afterward, the material is prestressed on the counterpressure cylinder and, only when the speed of the grinding cylinder is achieved and the material prestress on the counterpressure cylinder is achieved, the two cylinders are moved toward one another radially in such a way until the grinding paper comes into contact with the desired and predefined engagement depth on the surface of the material to be ground. Here, according to the invention, the grinding cylinder is operated at a speed which is at least five times higher than that of the counterpressure cylinder (receiving cylinder) with the printing form to be ground.

During the grinding process, the two cylinders can be moved radially toward one another further, until the printing form has been ground down to the desired thickness. Here, the speeds both of the grinding cylinder and of the counterpressure cylinder with the material to be ground can be changed during the grinding process, as long as the speed ratio according to the invention is maintained. In particular, the first engagement of the grinding paper into the surface to be ground can take place at a different speed, preferably at a lower speed, than the grinding process itself.

After the grinding process is completed, the material is moved radially out of the engagement of the grinding cylinder again, is stopped and subsequently the printing form is removed from the counterpressure cylinder.

In a further step, the ground printing form can be polished in the same machine or on a different machine. To this end, the printing form including counterpressure cylinder (receiving cylinder) is preferably transferred from the grinding machine into the polishing machine, in order to dispense with the removal of the printing form from one cylinder and subsequently pulling it onto the next cylinder. As an alternative, the same machine for grinding can also be used in that the grinding cylinder is exchanged for a polishing cylinder or the grinding paper on the grinding cylinder is replaced by a finer tool.

Figure 1:
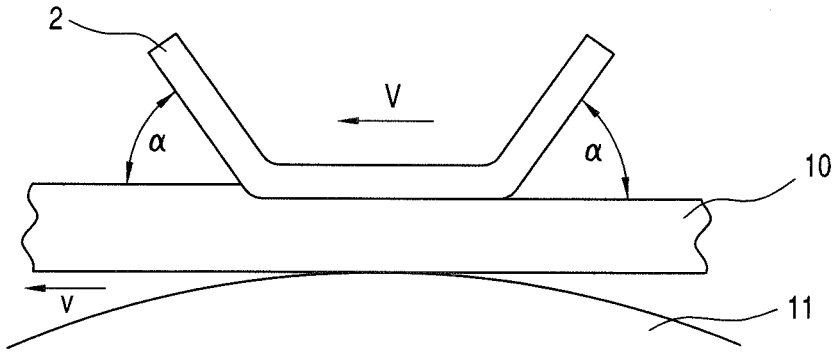
FIG. 1 is a schematic showing the material to be ground passing between a grinding belt and a cylinder; and, FIG. 2 is a schematic showing the material to be ground moving at a first speed (v) and a grinding belt or grinding paper moving at a second speed V at least five times greater than the first speed (v).
Figure 2:
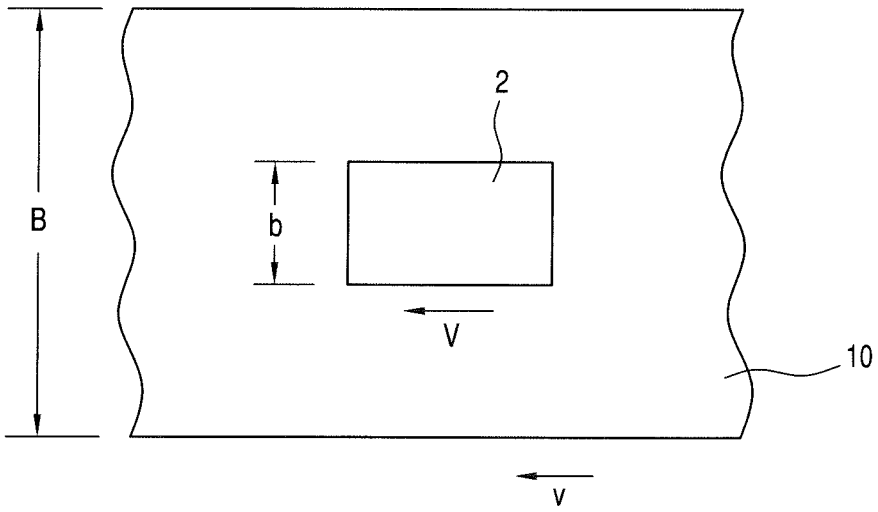

The method for grinding a printing form in the area of flexographic or relief printing will now be described with reference to FIGS. 1 and 2. The material 10 to be ground is an elastomer material or an elastomer-containing material.

The method is carried out by providing the material 10 to be ground and imparting a feed or first speed (v) thereto. The material is grindlingly abraded with a grinding belt or grinding paper 2 moving at a second speed V at least five times greater than the first speed (v). The grinding belt or grinding paper 2 has a grinding width (b) which is greater than approximately 0.5 mm and less than approximately 20 mm. The roll width of the material 10 to be abraded is given by reference character B.

The grinding can be carried out at an angular setting (a) of greater than approximately 0° and less than approximately 40° and the counterpressure during grinding is generated by a soft or compressible cylinder 11. At least 80% of the roll width B is ground in one work operation.

It is understood that the foregoing description is that of the preferred embodiments of the invention and that various changes and modifications may be made thereto without departing from the spirit and scope of the invention as defined in the appended claims.

What is claimed is:

1. A method for grinding a printing form for use in flexographic or relief printing wherein the material to be ground is an elastomer material or an elastomer-containing material, the method comprising the steps of:

providing said material to be ground and imparting a feed or first speed (v) thereto;

determining an angular setting (α) based on a hardness of said material;

said angular setting (α) defining an angle at which a grinding belt or a grinding paper dips into said material; and, grindlingly abrading said material at the angular setting (α) with the grinding belt or the grinding paper moving at a second speed (V) at least five times greater than said first speed (v) of said material to be ground.

2. The grinding method of claim 1, wherein the granularity of the grinding belt or grinding paper is at least approximately 240 mesh.

3. The grinding method of claim 1, wherein the grinding width (b) is greater than approximately 0.5 mm and less than approximately 20 mm.

4. The grinding method of claim 1, wherein the grinding is carried out at the angular setting (α) of greater than approximately 0° and less than approximately 40°.

5. The grinding method of claim 1, wherein the counterpressure during grinding is generated by a soft or compressible cylinder.

6. A method for grinding a printing form for use in flexographic or relief printing wherein the material to be ground is an elastomer material or an elastomer-containing material, the method comprising the steps of:

providing said material to be ground and imparting a feed or first speed (v) thereto; and, grindlingly abrading said material with a grinding belt or a grinding paper moving at a second speed (V) at least five times greater than said first speed (v), wherein:

the grinding is carried out with a first step and a second step;

the speed (V) of the grinding belt or the grinding paper is greater in the first step than in the second step; and/or, the roughness of the grinding belt or grinding paper is greater in the first step than in the second step.

7. The grinding method of claim 1, wherein the ground surface is polished by a following step.

8. The grinding method of claim 1, wherein at least 80% of the roll width (B) is ground in one work movement.

9. The grinding method of claim 1, wherein the grinding is carried out with a belt grinding machine or a cylinder grinding machine.

* * * * *